United States Patent [19]

Block

[11] 4,333,202

[45] Jun. 8, 1982

[54] FLOOR SCRUBBER WITH COMBINED SOLUTION AND RECOVERY TANK

[75] Inventor: Thomas S. Block, Muskegon, Mich.

[73] Assignee: McGraw-Edison Company, Rolling Meadows, Ill.

[21] Appl. No.: 108,295

[22] Filed: Dec. 28, 1979

[51] Int. Cl.[3] ..... A47L 11/20

[52] U.S. Cl. ..... 15/320; 15/340; 15/353

[58] Field of Search ..... 15/320, 321, 353, 302, 15/340

[56] References Cited

U.S. PATENT DOCUMENTS

| | | | |
|---|---|---|---|
| 3,552,100 | 1/1971 | Ekenberg | 15/353 X |
| 3,942,217 | 3/1976 | Bates | 15/321 |
| 4,041,567 | 8/1977 | Burgoon | 15/340 X |
| 4,068,340 | 1/1978 | Forward | 15/321 |
| 4,194,263 | 3/1980 | Herpers et al. | 15/320 X |
| 4,210,978 | 7/1980 | Johnson et al. | 15/320 |
| 4,218,805 | 8/1980 | Brazier | 15/321 |

*Primary Examiner*—Chris K. Moore

*Attorney, Agent, or Firm*—Thomas M. McKinley; Jon Carl Gealow; Hugh M. Gilroy

[57] ABSTRACT

A floor scrubbing apparatus including a combined solution and recovery tank is disclosed. The floor scrubber is of the type including a brush head, a squeegee and a vacuum system. A combined solution and recovery tank is operably connected to the vacuum system and the brush head. The tank is a one-piece, rigid integrally molded member having an inner wall and outer, spaced wall. The inner wall defines a recovery tank and the outer wall surrounding the inner wall defines therewith a solution tank. The one-piece member further defines an inlet opening, a solution drain opening, a recovery drain opening and a solution outlet tube.

16 Claims, 7 Drawing Figures

FLOOR SCRUBBER WITH COMBINED SOLUTION AND RECOVERY TANK

BACKGROUND OF THE INVENTION

The present invention relates to floor treating apparatus and more particularly to apparatus which scrubs a floor and removes the wet soilage from the floor in a single pass.

Various forms of floor treating machines are presently available which scrub a floor surface with a cleaning solution and remove the wet soilage from the floor. Such machines, if self propelled, are referred to as automatic floor scrubbers and typically include a brush head supporting one or more vertical axis brushes, a squeegee assembly which collects the wet soilage or dirty solution and a vacuum system which will pick up and remove the wet solution after the scrubbing operation. Such machines generally require only a single person for operation and may clean floor surfaces at 30,000 square feet per hour. A cleaning solution is automatically metered to the brush head from a solution tank. The vacuum system typically includes a blower having an inlet connected to the squeegee assembly through a recovery tank. The blower sucks up the wet soilage and deposits it in the recovery tank.

Examples of such prior machines of the general type just described may be found in U.S. Pat. No. 2,680,260 entitled SCRUBBING MACHINE WITH ROTATING BRUSH FOR SCRUBBING SURFACES and issued on June 8, 1954, to Danielsson et al; U.S. Pat. No. 2,978,719 entitled MOBILE FLOOR TREATING MACHINE and issued on April 11, 1961, to Arones; U.S. Pat. No. 3,277,511 entitled ADJUSTABLE WIDTH FLOOR TREATING MACHINE and issued on Oct. 11, 1966, to Little et al; U.S. Pat. No. 3,408,673 entitled FLOOR SCRUBBING MACHINE and issued on Nov. 5, 1968, to Oxel; U.S. Pat. No. 3,550,181 entitled APPARATUS FOR CLEANING FLOORS and issued on Dec. 29, 1970, to Dolan et al; U.S. Pat. No. 3,866,541 entitled SELF-PROPELLED FLOOR CLEANING APPARATUS WITH REMOVABLE BRUSH and issued on Feb. 18, 1975, to O'Connor et al; and U.S. Pat. No. 4,006,506 entitled SURFACE CLEANING MACHINE WITH SQUEEGEE ASSEMBLY and issued on Feb. 8, 1977, to Burgoon.

The prior floor scrubbing machines, whether manually or self propelled, have generally used separate, independent tanks for the cleaning solution and for storing the recovered dirty solution. The separate tanks are usually mounted side by side or in a front-to-back relationship. This mounting results in a shifting of the center of gravity of the machine during operation. This shifting is caused by transfer of the fluid from one tank to another and may have an adverse effect on machine operation. The changing center of gravity requires a four point support for the machine, that is, four floor surface engaging wheels must be used to ensure stable operation of the machine.

It has been proposed to mount the cleaning solution tank and the recovery tank in a top-to-bottom or one above the other relationship. Such arrangement may be acceptable in small, low capacity, manually propelled scrubbing machines such as illustrated in the aforementioned U.S. Patent to Dolan et al No. 3,550,181. With such an arrangement, the center of gravity of the scrubber will be raised or lowered during operation without a front-to-back or lateral shift. Top heaviness and resulting instability may become a problem.

When a one-on-top of the other tank arrangement is employed in a self-propelled floor treating machine, significant problems are experienced with proper location and sizing of the tanks and with stabilizing the machine to counteract top heaviness. Typically, the top-to-bottom tank arrangement is not adaptable to a battery powered, self-propelled floor scrubber since insufficient space is left to mount the batteries. U.S. Pat. No. 3,866,541 discloses an automatic scrubber with the recovery and solution tanks in a vertical relationship. This machine, however, employs an internal combustion engine driving a hydraulic pump and hydraulic motors to propel the apparatus. An internal combustion engine is unacceptable in most indoor environments within which a floor scrubber finds its primary utility.

SUMMARY OF THE INVENTION

In accordance with the present invention, a floor scrubbing machine is provided whereby the aforementioned problems are substantially alleviated. Essentially, the scrubber includes a combined solution and recovery tank defined by a one-piece, integral member having an inner wall and a spaced outer wall surrounding the inner wall. The members define rigid tanks for the cleaning solution and for the recovered dirty solution after the scrubbing operation. The member is essentially a "tank within a tank" and eliminates problems heretofore experienced with a changing center of gravity. The center of gravity of the scrubber in accordance with the present invention remains essentially unchanged during operation. This result increases the stability of the machine and permits a three wheel support for the scrubber, resulting in a machine better able to follow changing floor contours. The combined tank eliminates elements of a typical scrubber, reduces cost of manufacture and increases ease of assembly and efficiency of operation.

In narrower aspects of the invention, the tank is removably supported on a main frame of a self-propelled automatic scrubber and includes means for draining the recovery tank and the solution tank and for connecting the solution tank to a brush head. A blower supported on the main frame is connected to the combined tank through a pivotally mounted passage defining member which supports a float valve at one end within the recovery tank portion.

DETAILED DESCRIPTION OF THE PREFERRED EMBODIMENT

Figure 1:
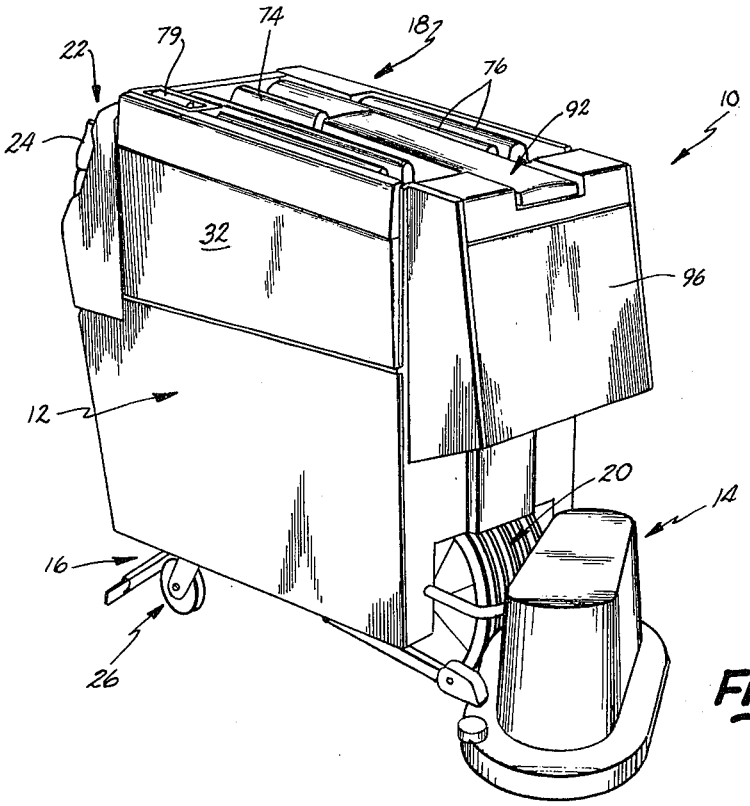
FIG. 1 is a front, right side perspective view of an automatic floor scrubber in accordance with the present invention.
Figure 2:
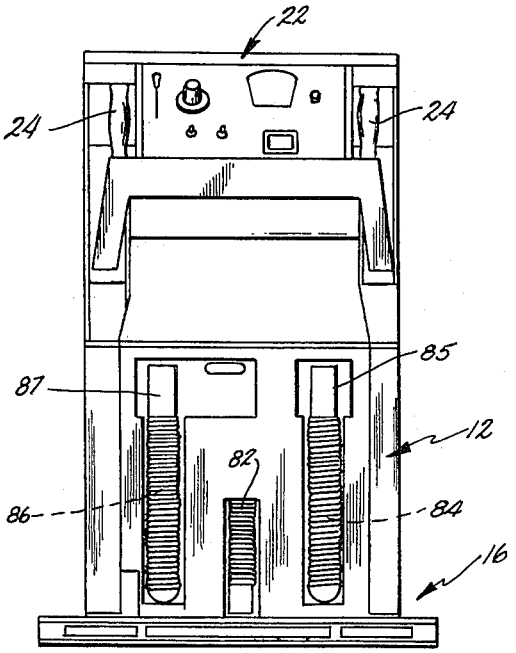
FIG. 2 is a rear elevational view of the scrubber of FIG. 1.

With reference to the drawings, FIG. 1 illustrates a floor treating machine in accordance with the present invention and which is generally designated 10. The floor treating machine is a battery powered, automatic floor scrubber including a paneled main frame structure 12 to which is secured a brush head subassembly generally designated 14, a squeegee subassembly generally designated 16 and a combined solution and recovery tank generally designated 18. The brush head subassembly 14 is described in detail in commonly owned, copending application Ser. No. 049,883 entitled FLOOR TREATING MACHINE and filed on June 19, 1979, in the name of the present inventor and now U.S. Pat. No. 4,218,798. As described in said copending application, the brush head subassembly 14 includes a modular support member to which is mounted an electric motor. The motor drives a centrally disposed, ground engaging drive wheel 20. As seen in FIGS. 1 and 2, main frame 12 also supports a suitable operator control panel 22 and control handles 24 for the operator.

The squeegee subassembly 16 trails brush head subassembly 14 in the direction of scrubber movement and collects the wet soilage or dirty cleaning solution after the scrubbing operation. A detailed description of the squeegee subassembly may be found in copending, commonly owned application Ser. No. 049,884 entitled SQUEEGEE FOR FLOOR TREATING MACHINE and filed on June 19, 1979, in the name of the present inventor.

The scrubber in accordance with the present invention has a three point support composed of the main drive wheel 20 and a pair of laterally positioned and transversely spaced caster wheels 26. The caster wheels are positioned at the rear of the scrubber just forward of the squeegee subassembly. This three wheel support allows the scrubber to more readily conform to varying floor contours which increases scrubber efficiency. As described in detail herein, the combined solution and recovery tank 18 permits use of this three point support since instability problems are eliminated. The batteries (not shown) which power the scrubber are mounted within the frame structure 12 immediately below the combined cleaning solution and recovery tank 18.

Figure 3:
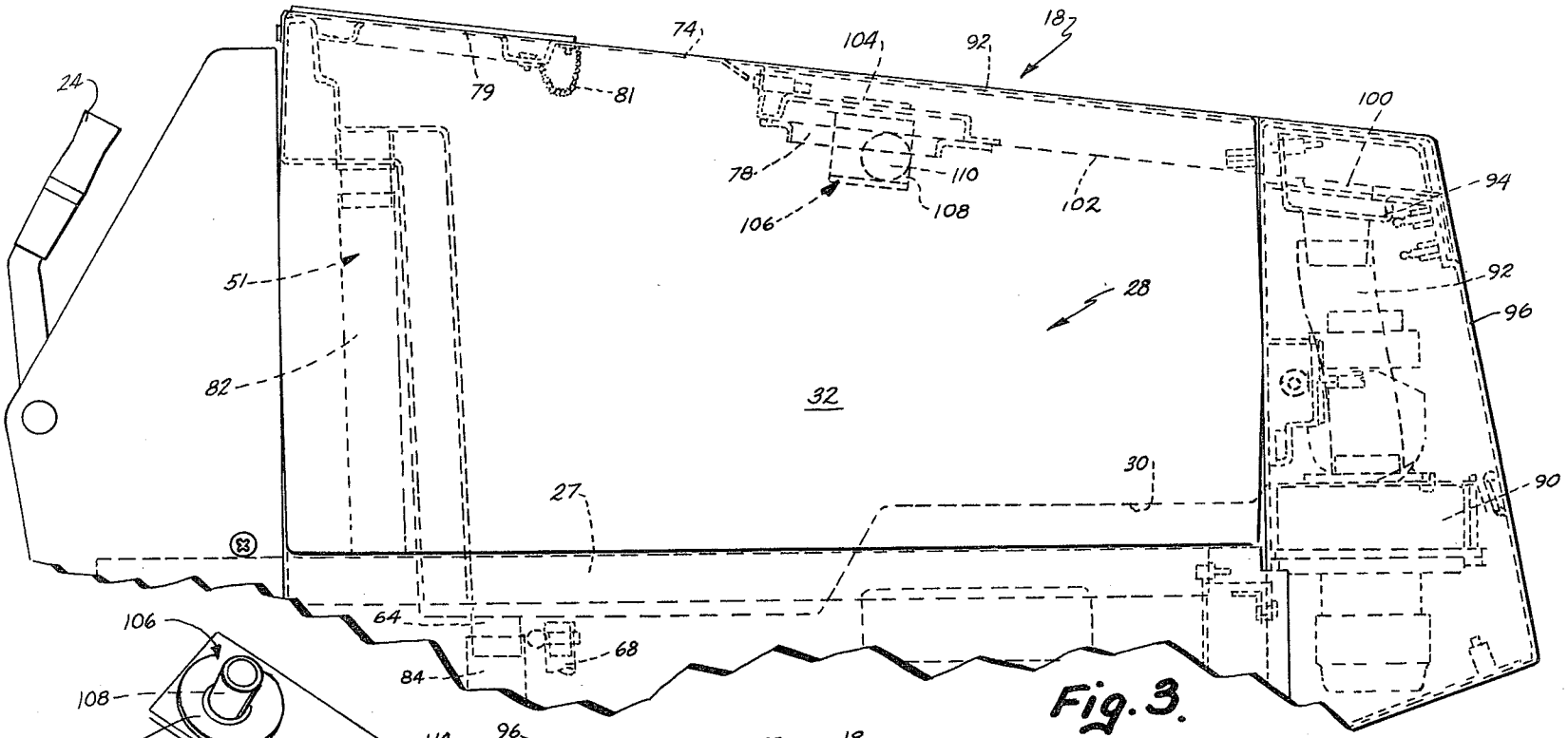
FIG. 3 is a fragmentary, side elevational view of the floor scrubber.

As best seen in FIG. 3, the frame structure includes a pair of longitudinally extending, transversely spaced tubular members 27 at each side of the scrubber. As explained in the aforementioned copending application Ser. No. 049,883, the tubular members function as a pressure reservoir tank. Also, the side tubular members support the combined solution and recovery tank 18.

Figure 4:
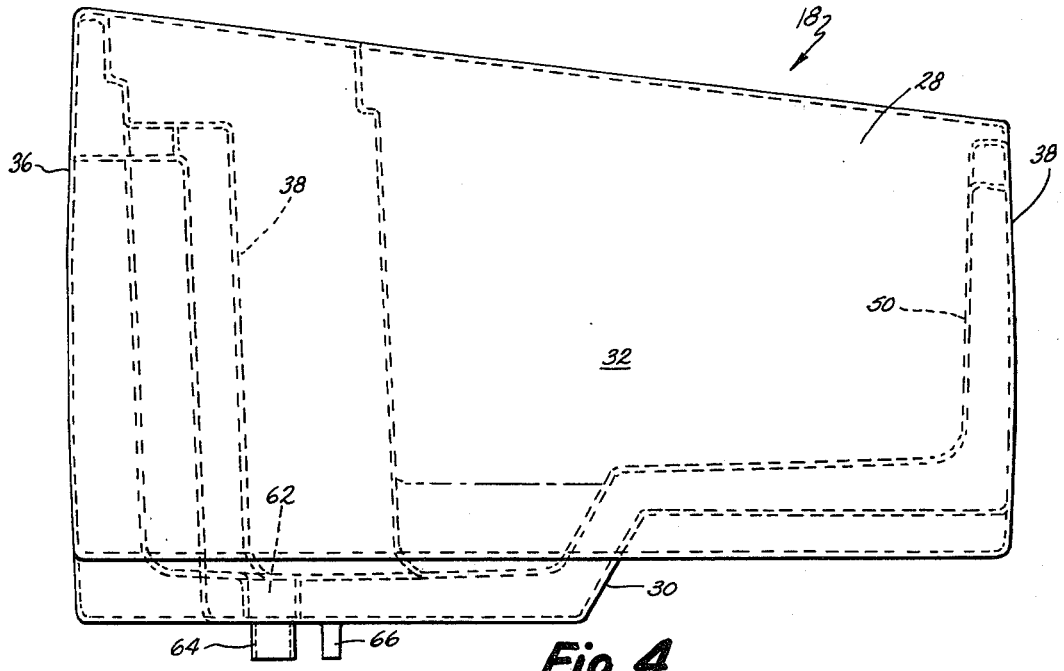
FIG. 4 is a right side, elevational view of the combined solution and recovery tank in accordance with the present invention.
Figure 5:
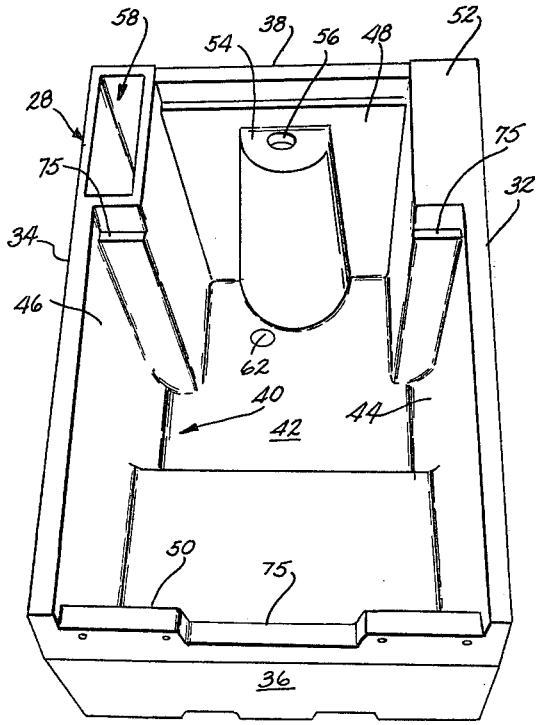
FIG. 5 is a top, perspective view of the solution and recovery tank.

Tank 18 is constructed so that the center of gravity of the scrubber does not change during the scrubber operation. This eliminates problems heretofore experienced with the front-to-back, side-to-side or top-to-bottom shifting of the center of gravity of the machine during operation. As best seen in FIGS. 3, 4 and 5, combined tank 18 includes an outer wall 28 defining a bottom 30, opposed sides 32, 34, a front 36 and a rear 38. Member 18 further includes an inner wall structure 40 (FIG. 5) which is formed integral with the outer wall 28 and is completely enclosed or surrounded by the outer wall. The inner wall is spaced from the sides, front, back and bottom of the outer wall and in turn includes its own inner bottom 42, inner sides 44, 46, rear 48 and inner front 50. The inner and outer walls are joined by a top portion 52 and define an integral, one-piece member having an open-ended top. It is presently preferred that the member be rotationally molded from a plastic material and preferably high density linear polyethylene having a flex-stiffness of 80,000 psi in accordance with ASTM-0747 specification and a density of 0.94 pounds per cubic foot.

The inner wall 40 defines the recovery tank portion, and the space between the inner wall 40 and the outer wall 28 defines the cleaning solution storage tank portion. The recovery tank defined by the inner wall 40 is in effect a "tank within a tank". The rear 38 of member 18 defines an inwardly directed, generally concave recess 51 extending from bottom 30 to a point short of top portion 52. As seen in FIG. 5, the wall further defines a top member 54 having an aperture 56 formed therein. Aperture 56 communicates recess 51 with the recovery tank portion of member 18 and serves as an inlet for the dirty cleaning solution or wet soilage which is recovered by the vacuum system.

The peripheral, top portion 52 and walls 28, 40, as also seen in FIG. 5, define a rectangular-shaped aperture 58 which opens into the space between the inner and outer walls. Aperture 58 is an access aperture for filling of the cleaning solution tank portion with a cleaning solution.

Figure 6:
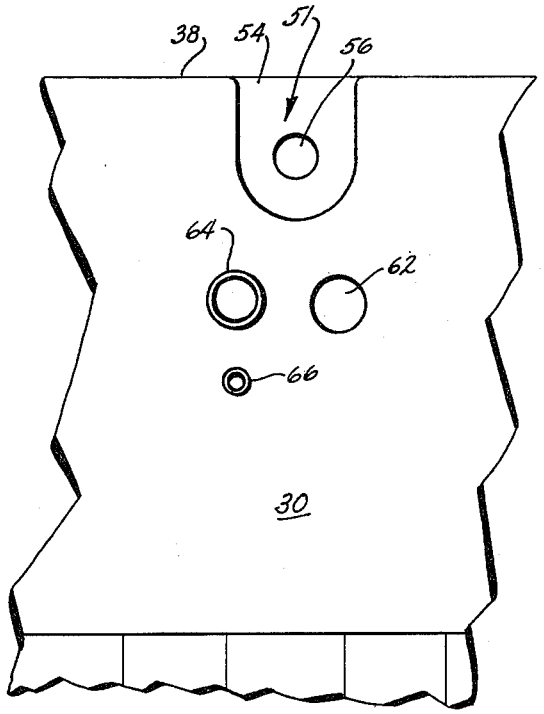
FIG. 6 is a fragmentary, bottom plan view of the tank.

As best seen in FIGS. 4 and 6, the tank is preferably integrally molded with a recovery solution drain tube 62 extending through the bottom 30 and opening through bottom 42 into the recovery tank portion. Further, the tank is integrally molded with a cleaning solution drain tube 64 which opens into the cleaning solution tank portion through bottom 30 of the outer wall 28. Finally, a cleaning solution outlet tube 66 opens through bottom 30 of outer wall 28 and into the cleaning solution tank portion. Outlet tube 66 is connected through suitable tubing 68 (FIG. 3) to the brush head. The tubing directs the cleaning solution to the brushes for scrubbing in a known manner.

Figure 7:
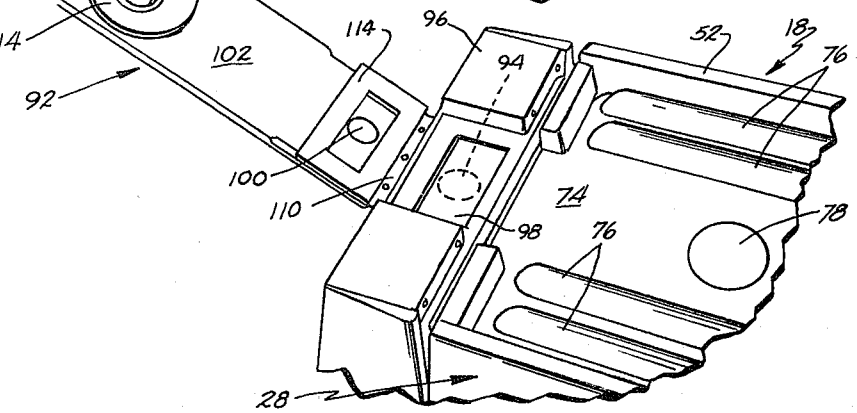
FIG. 7 is a top, fragmentary, perspective view of the floor scrubber.

As seen in FIGS. 1 and 7, the top open end of the recovery tank portion is closed by a suitable cover or plate 74. Cover 74 is suitably secured to tank 18 at ledges 75 (FIG. 5) defined by inner wall 40 and by peripheral edge 52. Cover 74 is sealed to the tank by a suitable adhesive or by a heat welding process. Cover 74 may include suitable ridging 76 to increase its stiffness. Further, cover 74 defines an aperture 78 which opens into the recovery tank portion of the combined tank 18.

The solution inlet opening 58 is closed by a cover or closure 79. Cover 79 may be secured to tank 18 by a length of chain 81 (FIG. 3).

As best seen in FIGS. 2 and 3, the squeegee subassembly 16 is connected to the recovery tank inlet aperture 56 by a suitable length of flexible tubing 82. Tubing 82 extends from the squeegee subassembly 18 and vertically within the confines of the concave recess or tunnel 51 defined by the front of the tank. Drain tubes 62, 64 have suitable lengths of flexible tubing 84, 86, respectively, connected thereto. Each length of tubing 84, 86 extends downwardly within the scrubber and is bent upwardly and stored at the rear panel of the scrubber (FIG. 2). Tubing 84, 86 is provided with suitable caps (not shown) at their free ends 85, 87. Draining of the recovery tank and the solution tank is readily accomplished merely by removing the caps and dropping the tubes 84, 86 from their stored positions.

Recovery tank portion defined by inner wall 40 is connected to a suitable motor driven blower generally designated 90 in FIG. 3 by a pivotal passage defining member 92. As best seen in FIGS. 3 and 7, blower 90 is a centrifugal blower. A length of tubing 92 connects blower 90 to an aperture 94 formed in a forward housing portion 96 of the scrubber. A reticulated foam filter 98 is positioned over aperture 94 (FIG. 7).

Member 92 is generally rectangular in cross section and is preferably molded from plastic. Member 92 defines an outlet opening 100 formed in a bottom wall 102 thereof and an inlet opening 104 (FIG. 3). Positioned at the inlet opening 104 is a suitable float valve 106. Float valve 106 includes a cage 108 within which is positioned a float ball 110.

As seen in FIG. 7, member 92 is pivoted to housing 96 adjacent outlet aperture 100 by a hinge 110. When member 92 is in the raised or pivoted position, as shown in FIG. 7, the tank may be lifted off the scrubber. In order to connect blower 90 to the tank, member 92 is pivoted in a clockwise direction, when viewed in FIG. 7, until float valve 106 is positioned through aperture 78 of cover 74. Suitable seals 114 are positioned around aperture 100 and float valve 106 to seal member 92 at apertures 94 and 78. Upon actuation of the blower motor, wet soilage or dirty cleaning solution will be sucked up from the squeegee 16 through flexible tubing and through inlet aperture 56 to the recovery tank portion. When the recovery tank portion fills with the dirty solution, float valve ball 110 will raise and close off the inlet aperture 104 of the passage defining member 92. This prevents sucking of the wet solution into the blower motor.

OPERATION

In operation, the operator of the automatic scrubber 10 will actuate the drive motor and the brush head subassembly 14 from the control panel portion 22 at the rear of the scrubber. Cleaning solution stored within the cleaning solution tank portion defined by the inner and outer walls is metered to the brush head assembly. Squeegee subassembly 16 will collect the wet soilage or dirty cleaning solution and direct it to tube 82. Blower 90 sucks the solution up tube 82 and into the recovery tank. As the level of fluid within the cleaning solution tank portion drops, the level of fluid within the recovery tank portion rises. Since the amount of cleaning solution dispersed substantially equals the amount recovered, the center of gravity of the scrubber remains essentially the same during operation.

When the recovery tank portion is filled, hose 86 is removed from its stored position and uncapped to permit emptying of the wet soilage. Easy access is provided to the cleaning solution tank portion through the aperture 58 for filling.

The overall vertical height of the scrubber is reduced from that which would be required if a recovery tank and cleaning solution tank were mounted in a vertical relationship as opposed to the "tank within a tank" relationship of the present invention. The combined tank 18 is easily and relatively inexpensively manufactured employing conventional rotational molding processes from rigid plastic materials. The integral, one-piece unit is easily mounted on the scrubber and is readily removable.

The constant center of gravity of the scrubber permits the three point suspension or three wheel structure to be used. Employing three wheels allows the scrubber to more readily conform to the changing contours of the floor surface which is being cleaned. This increases scrubber efficiency. Further, top heaviness problems, stability and control problems which could result from a change in the center of gravity are eliminated. A much more reliable scrubber is provided at reduced costs from that heretofore experienced. A minimum of parts are employed which also increases ease of assembly and reduces cost of manufacture.

In view of the foregoing description, those of ordinary skill in the art will undoubtedly envision various modifications to the embodiment illustrated which would not depart from the inventive concepts disclosed herein. For example, the drain tubes need not be molded integral with the tank structure but could be separate tubes positioned in suitable apertures formed during the fabrication process. Further, the specific configuration of the tank structure could be changed.

Therefore, it is expressly intended that the above description should be considered only as that of the preferred embodiment. The true spirit and scope of the present invention may be determined by reference to the appended claims.

The embodiments of the invention in which an exclusive property or privilege is claimed are defined as follows:

1. In a unitary floor scrubbing apparatus of the type including a scrubber means for scrubbing a floor surface, vacuum means for recovering the dirty solution from the floor surface and an improved removable cleaning solution and recovery storage means for containing the cleaning solution and the recovered cleaning solution, wherein said improved cleaning solution and recovery storage means comprises:

a rigid member having spaced inner and outer walls, said inner wall including an inner bottom and four inner side walls, said outer wall including an outer bottom and four outer side walls, said inner and outer wall defining a pair of tanks, one of said tanks being a cleaning solution storage tank and the other of said tanks being a recovery tank, said recovery tank having at least one orifice for receiving the dirty solution and said cleaning solution storage tank having orifices for receiving and discharging cleaning solution to be applied to the floor surface;

a top affixed to said recovery tank permanently and substantially closing said recovery tank and containing an aperture opening into said recovery tank;

connecting means between said vacuum means and the aperture in said top of said recovery tank for applying a vacuum to said recovery tank, said connecting means having a substantially rigid movable portion terminating in an inlet of said connecting means to said vacuum means, which inlet is in sealing disconnectable connection to the aperture in said top;

drain means connected to said member for permitting selective draining of the contents of said tanks.

2. In a floor scrubbing apparatus as defined by claim 1 wherein said vacuum means includes a squeegee for collecting the dirty solution and a hose extending from said squeegee to said recovery tank.

3. In a floor scrubbing apparatus as defined by claim 2 wherein said inner wall defines said recovery tank portion and the space between said inner and outer walls defines said cleaning solution tank portion, said recovery tank portion being positioned within said cleaning solution tank.

4. In a floor scrubbing apparatus as defined by claim 3 wherein said drain means includes a movable conduit for directing the draining solution away from said unitary floor scrubbing apparatus.

5. In a floor scrubbing apparatus as defined by claim 1 further including float means at said inlet of said connecting means and extending into said recovery tank portion for closing off said connecting means when said recovery tank portion fills with dirty solution.

6. In a floor scrubbing apparatus as defined by claim 1 wherein said rigid member is molded from plastic as a single piece.

7. In a floor scrubbing apparatus as defined by claim 4 wherein said drain means comprises a tubular member extending through said outer wall and opening through said inner wall to permit dirty solution to drain from said recovery tank portion.

8. In a floor scrubbing apparatus as defined by claim 7 wherein said member is molded from plastic as a single piece and further defines a cleaning solution outlet tube opening through said outer wall and which is connected to said scrubbing means.

9. In a floor scrubbing apparatus as defined by claim 8 wherein said drain means further includes another tubular member opening through said outer wall to permit cleaning solution to be drained from said cleaning solution tank.

10. A combined solution and recovery tank removably mounted on a unitary floor scrubbing apparatus of the type having a frame, a brush head mounted on the frame, a squeegee, a blower, and drive means, said solution and recovery tank comprising:

a rigid, one-piece, integrally mounted molded member including spaced inner and outer walls, said inner wall defining a recovery tank including an inner front, an inner back, an inner bottom and two inner side walls, said outer wall surrounding said inner wall and including an outer front, an outer back, an outer bottom and two outer side walls, said outer wall defining with said inner wall a solution tank surrounding said recovery tank, said member further defining an inlet opening into said solution tank for receiving cleaning solution, an inlet opening into said recovery tank for receiving dirty solution, a solution drain opening into said solution tank, a recovery drain opening into said recovery tank and a solution outlet tube for discharging cleaning solution from said solution tank to be applied to a floor;

means for permanently and substantially closing an open top end of said recovery tank, said means for closing defining a vacuum inlet aperture opening into said recovery tank; and connecting means for applying a vacuum generated by said blower to said recovery tank, said connecting means having a movable substantially rigid portion in sealing disconnectable connection to said vacuum inlet.

11. An automatic, battery powered floor scrubbing machine comprising:

a frame;

drive means on said frame for moving the scrubber along a floor surface;

scrubbing means secured to said frame for scrubbing a cleaning solution onto a floor;

squeegee means secured to said frame for collecting the cleaning solution after it is scrubbed onto the floor;

vacuum means connected to said squeegee means for recovering dirty cleaning solution from the floor as it is collected by said squeegee means;

a rigid, one-piece integrally formed member removably supported on said frame and including spaced inner and outer walls, said inner wall defining a recovery tank including an inner front, an inner back, an inner bottom and two inner side walls, said outer wall surrounding said inner wall and including an outer front, an outer back, an outer bottom and two outer side walls, said outer wall defining with said inner wall an outer solution tank surrounding an inner recovery tank, said member further defining a first inlet opening into said solution tank for receiving cleaning solution, a second inlet opening into said recovery tank for receiving dirty solution, a solution drain opening into said solution tank, a recovery drain opening into said recovery tank, and a solution outlet tube for discharging cleaning solution from said solution tank to be applied to a floor;

a top affixed to said recovery tank permanently and substantially closing said recovery tank and containing an aperture opening into said recovery tank;

connecting means between said vacuum means and the aperture in said top of said recovery tank for applying a vacuum to said recovery tank, said connecting means a having substantially rigid movable portion terminating in a connecting inlet of said connecting means to said vacuum means, said connecting inlet in sealing disconnectable connection to the aperture in said top.

12. A floor scrubbing machine as defined by claim 11 further including valve means at said connecting inlet for closing said connecting inlet when said recovery tank is filled with dirty solution.

13. A floor scrubbing machine as defined by claim 11 wherein said rigid member is molded from plastic as a single piece.

14. A unitary floor scrubbing apparatus as claimed in claim 4, wherein said connecting means movable portion is in sealing disconnectable connection to the remaining portion of said connecting means which leads to said vacuum means, and said movable portion pivots between a sealed position and a disconnected position.

15. A combined solution and recovery tank as claimed in claim 10 further comprising a cleaning solution cover for closing said inlet opening into said solution tank.

16. A floor scrubbing machine as defined by claim 11 wherein said drive means includes a single, centrally disposed ground engaging wheel and said scrubbing machine further includes a pair of caster wheels at the rear thereof.

* * * * *